US011802737B2

(12) United States Patent
Wickham et al.

(10) Patent No.: US 11,802,737 B2
(45) Date of Patent: Oct. 31, 2023

(54) HELICALLY COILED HEAT EXCHANGE ARRAY

(71) Applicant: Struthers Energy and Power Limited, Hull (GB)

(72) Inventors: Mark Wickham, London (GB); Neil Burton, London (GB)

(73) Assignee: Struthers Energy and Power Limited, Hull (GB)

( * ) Notice: Subject to any disclaimer, the term of this patent is extended or adjusted under 35 U.S.C. 154(b) by 0 days.

(21) Appl. No.: 17/584,980

(22) Filed: Jan. 26, 2022

(65) Prior Publication Data

US 2022/0325958 A1 Oct. 13, 2022

Related U.S. Application Data

(63) Continuation of application No. 15/033,361, filed as application No. PCT/GB2014/053247 on Oct. 31, 2014, now abandoned.

(30) Foreign Application Priority Data

Oct. 31, 2013 (GB) ..... 1319284

(51) Int. Cl.

| | |
|---|---|
| ***F28D 7/00*** | (2006.01) |
| ***F28D 7/02*** | (2006.01) |
| ***B21D 53/02*** | (2006.01) |
| ***F28D 21/00*** | (2006.01) |
| ***F28F 9/02*** | (2006.01) |
| *B21D 11/06* | (2006.01) |

(52) U.S. Cl.

CPC ..... *F28D 7/022* (2013.01); *B21D 53/027* (2013.01); *F28D 7/024* (2013.01); *F28D 21/0003* (2013.01); *F28F 9/0243* (2013.01); *B21D 11/06* (2013.01); *F28F 2265/26* (2013.01)

(58) Field of Classification Search

CPC ..... F28D 7/022; F28D 7/024; F28D 21/0003; F28D 7/02; F28D 7/028; B21D 53/027; B21D 11/06; B21D 53/02; F28F 9/0243; F28F 2265/26; F28F 9/02; F28F 9/0132; F28F 9/007

See application file for complete search history.

(56) References Cited

U.S. PATENT DOCUMENTS

| | | | | |
|---|---|---|---|---|
| 3,083,447 A * | 4/1963 | Andersen | ..... | F28F 9/0132 29/890.037 |
| 3,265,276 A * | 8/1966 | Roffelsen | ..... | B21F 17/00 228/43 |
| 6,325,139 B1 * | 12/2001 | Maruyama | ..... | F28D 7/024 165/145 |

FOREIGN PATENT DOCUMENTS

| | | | | |
|---|---|---|---|---|
| GB | 1163804 A * | 6/1967 | | |
| GB | 2463482 A * | 3/2010 | ..... | B21C 47/02 |

* cited by examiner

*Primary Examiner* — Harry E Arant
(74) *Attorney, Agent, or Firm* — Fox Rothschild LLP

(57) ABSTRACT

A heat exchange array arranged to be used in a heat exchange unit and further arranged to recover energy from an exhaust gas, comprising: a first heat exchange tube and a second heat exchange tube, each arranged to carry a heat exchange medium and further each comprising a series of external fins; and wherein the first heat exchange tube comprises a left-handed helically coiled tube having an first elastic stress, and the second heat exchange coil comprises a right-handed helically coiled tube having a second elastic stress, and wherein the first and second heat exchange tubes are interconnected such that the first elastic stress opposes the second elastic stress.

19 Claims, 9 Drawing Sheets

HELICALLY COILED HEAT EXCHANGE ARRAY

This application is a continuation of U.S. patent application Ser. No. 15/033,361, filed Apr. 29, 2016, which is the U.S. National Phase of International Application No. PCT/GB14/53247, filed Oct. 31, 2014, which claims priority to foreign application no. GB1319284.4, filed Oct. 31, 2013, the disclosures of which are incorporated herein by reference in their entirety.

The present invention relates to a heat exchange array for use in a heat exchange unit for recovering energy from an exhaust gas, and a method of manufacture of such a heat exchange array. In particular, but not exclusively, the present invention relates to heat arrays suitable for large-scale applications such for heat exchange units associated with power plants.

A heat exchange unit is typically implemented to recover energy from the exhaust gas of a gas turbine used in a power plant, or the like. The use of such a heat exchange unit can significantly increase the overall efficiency of the plant as less energy is lost in the exhaust gas. In order to recover the heat energy, the exhaust gas is passed through a heat exchange unit comprising a heat exchange array. Such a heat exchange array comprises a series of tubes arranged to carry a heat exchange medium (such as water). The heat exchange medium is heated by the exhaust gas, and can be used for further processes.

Typically, a heat exchange array is made up from a series of concentric coils of tubing, manufactured by winding a straight length of tube around a rotating body. As the tube is wound into a coil, stresses are produced within the coil as the metal used to manufacture the tubing undergoes plastic and elastic deformation. Once wound into a coil, it can be difficult to keep the tubing wound in a stable shape as the elastic stress forces act to unwind the coil. This becomes less of a problem once the coil is installed into the heat exchange unit, as it is typically fitted to an external housing that adds strength and stability to the coil and prevents it from unwinding.

Completely relieving the stress with in coils is known to be difficult to achieve. A typical method of reducing stress within a deformed metal would be to heat the finished structure. Some embodiments of the heat exchange array in question are of such a large size that it is not feasible to heat the entire array in an oven to reduce the elastic stress.

U.S. Pat. No. 3,083,447 shows a method of bundling plain coils without external fins.

In a first aspect, the present invention provides a heat exchange array for use in a heat exchange unit for recovering energy from an exhaust gas. Typically the heat exchange array comprises at least a first heat exchange tube and a second heat exchange tube, each arranged to carry a heat exchange medium. The first heat exchange tube may comprise a left-handed helically coiled tube having a first elastic stress. The second heat exchange coil may comprise a right-handed helically coiled tube having a second elastic stress. Typically the first and second heat exchange tubes are interconnected such that the first elastic stress opposes the second elastic stress.

Conveniently, either one, or both, of the first and second heat exchange tubes comprises external fins. Typically both tubes would comprise external fins. This increases the surface area of the heat exchange coils to improve the efficiency of energy transfer from an exhaust gas to the heat transfer medium within the tubes.

The skilled person will understand that many different kinds of fins could be used. In particular some embodiments may use circular fins and/or spiral fins may be used.

In embodiments wherein circular fins are used, each fin is annular in shape.

In embodiments wherein spiral fins are used, each fin spirals around the tube. There may be a single spiral fin on a tube or multiple spiral fins. In such embodiments, each turn of substantially 360° of the or each spiral fin may be thought of as a fin.

The skilled person will understand that various fin thicknesses and fin spacings may be used without departing from the scope of the invention. The spacing of the fins may be such that on each 5 cm section of tube there are between substantially 1 and 20 fins, or preferably between substantially 5 and 15 fins, or more preferably substantially 10 fins. Each fin may have a thickness of between 0.5 and 5 mm, or more preferably between 1 and 3 mm.

However, the coiling of such finned coils is problematic and they are harder to bend when compared to plain coils. The increased difficulty in bending finned coils is due to the nature of the fins. The skilled person will understand that fins are relatively thin and may be fragile such that there is a risk of damage to the fins on bending finned tubes. Further, the fins may be sufficiently flexible to bend when the finned tube is bent. The skilled person will understand that any damage or bending of the fins is generally disfavoured as it can lead to a reduction in the available surface area for heat transfer and/or to more uneven heat transfer.

Embodiments that are wound such that the first and second heat exchange tubes have opposing chirality are believed advantageous as the elastic stress forces therein will act in opposite directions. By producing a heat exchange array from interconnected right-handed and left handed helically coiled heat exchange tubes, the elastic stress forces are (at least in part) counterbalanced. Such embodiments should therefore have a reduced overall resultant stress in the heat exchange array and reduces the chances of its shape becoming distorted or the coils tending to un-wind. The use of heat exchange tubes of opposite chirality may also be advantageous because it may allow the tubes to be more efficiently packed into a given volume and may allow the turns of the coils to be distributed more evenly throughout the heat exchange array.

Optionally, the first and second heat exchange tubes are interconnected via a support member, which is typically rigid, arranged to hold the helically coiled tubes in a fixed shape. Embodiments having this feature are believed advantageous as the heat exchange array is helped to stay in a stable shape. The support member may act to transmit the elastic stress forces between each coil such that they can be counterbalanced.

Optionally the support member comprises at least one support bracket defining apertures each of which is arranged to receive a turn of the helically coiled tubes. Each turn of the helical tubes passes through an aperture in the support member to secure it in position. The support member is typically arranged to hold the turns of the helical coils in a fixed position relative to each other such that they maintain their shape.

In at least some embodiments, the or each support member has a length (ie a width) along the circumference of the coil supported thereby such that the or each support bracket supports a plurality of fins. Such an arrangement facilitates the use of finned tubes as the load is distributed over a plurality of fins, so reducing the likelihood and/or extent of bending or damage of fins. A typical length for a support may be roughly between 20 and 100 mm, roughly between 40 and 80 mm, or more preferably around 60 mm. The number of fins supported by each support may be roughly between 3 and 20, roughly between 5 and 15, or more preferably around 12.

In addition to providing support for the coils in use, the support members may also be used in assembling the coils, as is explained in more detail below.

Conveniently, the heat exchange array further comprises a header connected to an end region of the first and an end region of the second heat exchange tubes, the header arranged to provide an input and/or output for a heat exchange medium into the tubes.

A single connection to the header may therefore be used to input and/or output the heat exchange medium from all of the coils at the same time.

In some embodiments, the first and second heat exchange tubes are connected to the header from different directions, which may typically be from different sides of an axis of the header and in some embodiments may be opposing directions. Such embodiments allow easier access to joints between the heat exchange tubes and the header so that they can be more easily bonded together such as by welding, brazing, or the like. By connecting to the header from opposite directions the elastic stress forces acting on the header are in opposing directions may, at least partly, be cancelled out.

In additional or alternative embodiments, the first heat exchange tube has substantially the same length as the second heat exchange tube. Such an arrangement means that the heat exchange medium, travelling at a given speed, spends the same amount of time in each of the heat exchange tubes and so is imparted with an equal amount of heat energy.

Optionally, the first heat exchange tube comprises a left-handed helically coiled tube having a first pitch and second heat exchange tube comprises a right-handed helically coiled tube having a second pitch, wherein the first pitch is not equal to the second pitch. By altering the pitch of the coils they can have the substantially the same length whilst also ending at the same position. By increasing the pitch a helical coil with larger radius of curvature can be made the same length as a helical coil of smaller radius of curvature. By all ending at the same position, the first and second heat exchange tubes are more easily attached to the header.

In some embodiments the first heat exchange tube and the second heat exchange tube are arranged co-axially and such embodiments provide a compact arrangement of coils.

Optionally, the first heat exchange tube surrounds the second heat exchange tube, or vice versa (i.e. the radius of curvature of the left-handed helically coiled tube is greater than the radius of curvature of the left-handed helically coiled tube, or vice versa). This allows first and second heat exchange tubes to be formed into concentric layers of helical coils.

Conveniently, the heat exchange array comprises a plurality of first and/or second heat exchange tubes arranged into a plurality of concentric layers. This compact formation gives a large number of coils in a small space and so improves the energy transfer to the heat exchange medium.

Optionally, each of the concentric layers comprises a plurality of left-handed helically coiled tubes each having the same radius of curvature, or a plurality of right-handed helically coiled tube tubes each having the same radius of curvature. This increases the number of each type of coil in each layer thus producing a compact formation of coils.

In some embodiments, the concentric layers alternate between comprising first heat exchange tubes and comprising second heat exchange tubes. By alternating between left and right handed helical coils, the elastic stresses are more evenly balanced throughout the heat exchange array and its shape is less likely to be distorted.

Optionally, the heat exchange array comprises an equal number of first and second heat exchange tubes. By having an equal number of left and right handed helical coils, there may be more of a balance of stress forces acting in each of the opposing directions which may effectively balancing out the overall forces.

Optionally, the first and second heat exchange tubes are circular in cross section, and have a diameter of approximately 21 mm and 168 mm. Such diameters are suited to use for heat reclamation from an exhaust gas of a power station turbine. For such large scale applications the elastic stress created m winding such large diameter tubes is particularly large and so it is advantages to balance out the stress forces using coils of opposite chirality.

Optionally, the radius of the left-handed helically coiled tube and right-handed helically coiled tube is between substantially 1 m and 4 m. Such sized coils are suitable for use in a heat exchange unit for a power station or similar large scale application.

In a second aspect, the present invention provides a heat exchange unit comprising the heat exchange array described above. Such a heat exchange unit is suitable for use in heat recovery from gas exhaust from a power plant from example.

In a third aspect, the present invention provides a method of manufacturing a heat exchange array comprising a plurality of heat exchange tubes using a rotatable mandrel, the method comprising one or more of the following steps:

(a) providing at least one first support member on a roller portion of the mandrel to receive a first heat exchange tube;
(b) holding one end of a first heat exchange tube to the first support member;
(c) rotating the roller, whilst feeding the first heat exchange tube along a length of the roller in a first direction to form the first heat exchange tube into a first helical coil;
(d) attaching a second support member, arranged to receive a second heat exchange tube, to the first support member;
(e) holding one end of the second heat exchange tube to the second support member; and
(f) rotating the roller in the same direction, whilst feeding the second heat exchange tube along a length of the roller in a second direction to form the second heat exchange tube into a second helical coil, wherein the first direction is opposite to the second direction such that first helical coil is of opposite chirality to the second helical coil.

Such a method produces an array of heat exchange coils comprising a heat exchange coil that has a right-handed helix and a heat exchange coil that has a left-handed helix. As described above, the elastic stress forces in such an arrangement of coils will be cancelled out to help stabilise the shape of the coils.

Optionally, the method further comprises repeating steps (a) to (f) to provide a heat exchange array comprising a plurality of the first and/or the second heat exchange coils in a plurality of concentric layers. This builds the heat exchange array into a series of concentric layers.

Optionally, step (b) comprises holding a plurality of first heat exchange tubes to the first support member so that each concentric layer comprises a plurality of first heat exchange coils. This adds additional tubes of the same helically chirality to each layer.

Conveniently, steps (c) and (f) comprise applying a pulling force to the heat exchange tubes in a direction away from the roller as the roller is rotated. Advantageously, the pulling force helps to ensure that the heat exchange tubes are coiled under tension. The skilled person will understand that, if the heat exchange tubes were wound on loosely, the heat exchange tubes could spring off the support members.

Conveniently, step (e) comprises holding a plurality of second heat exchange tubes to the second support member so that each concentric layer comprises a plurality of second heat exchange coils. This adds additional tubes of the same helical chirality to each layer.

In some embodiments, the or each heat exchange tube is a finned tube. Preferably, some or all of the support members used have a width sufficient to encompass a plurality of fins on the finned tube. Advantageously, this distributes the load over the plurality of fins, so reducing the force on each fin and reducing the likelihood and/or extent of bending or damage of fins.

Conveniently, one or more shims are inserted between the support members during steps (a) to (f). In some embodiments, the shims may be positioned parallel to the support members.

The height of each shim is preferably selected such that the heat exchange tube is supported at the same radius from the coil axis by the shim as by the support members. The height of each shim typically extends between the outer edge of the fins of one heat exchange tube to the inner edge of the fins of the next heat exchange tube. The shims are typically located between the concentric layers of coils.

Advantageously, use of the shims helps to ensure that the heat exchange tubes do not kink at the support members and that the coils are substantially circular in cross-section/that the diameter of the coil is constant.

Typically, between 1 and 10 and more preferably from 3 to 4 shims are used per support member. The width of the shims may be between 20 and 100 mm, between 40 and 80 mm, or more preferably around 60 mm.

Preferably, the shims are removed once the coil is completed.

Embodiments of the invention will now be described, by way of example only, with reference to the accompanying drawings, in which.

Figure 8A:
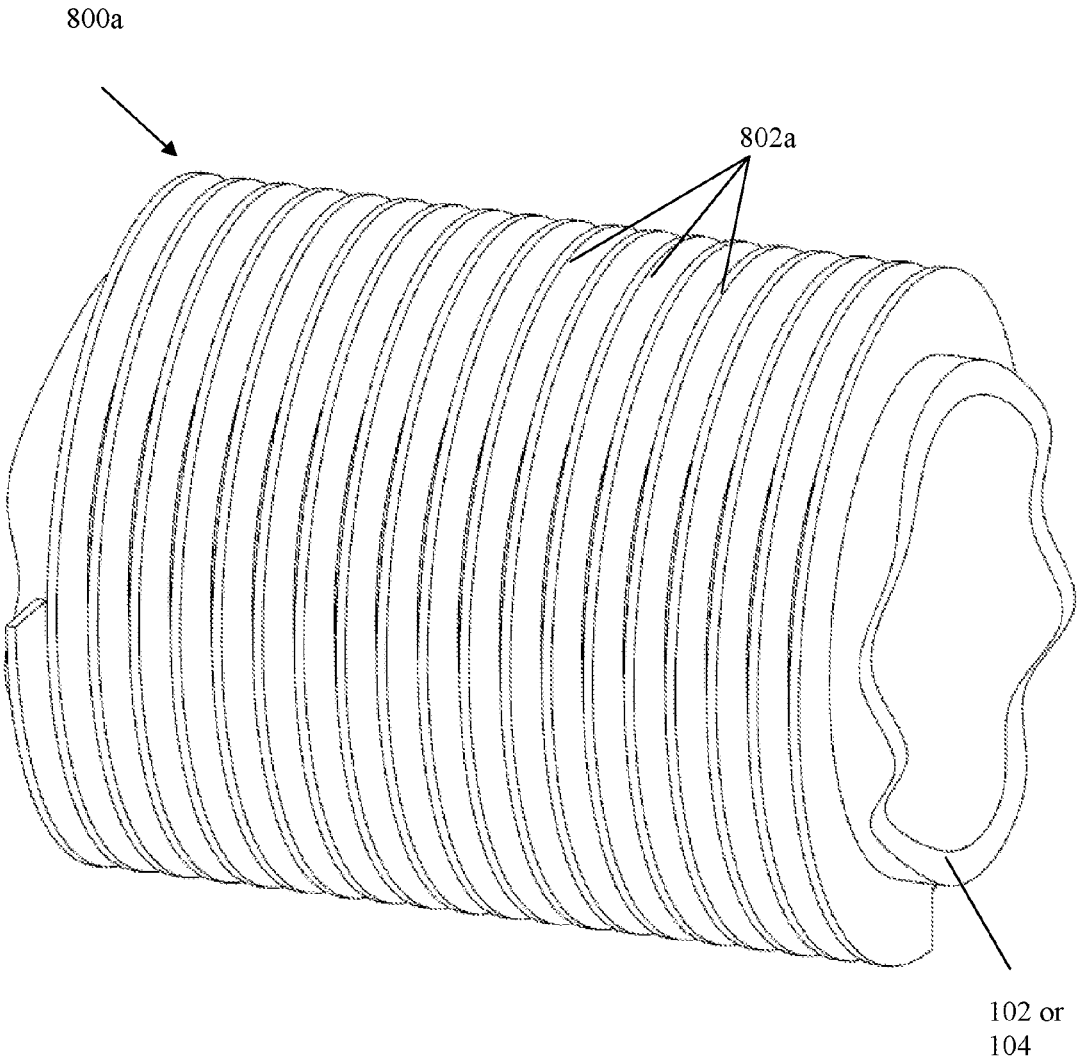

FIG. 8*a* shows a segment of a tube with external fins; and

Figure 8B:
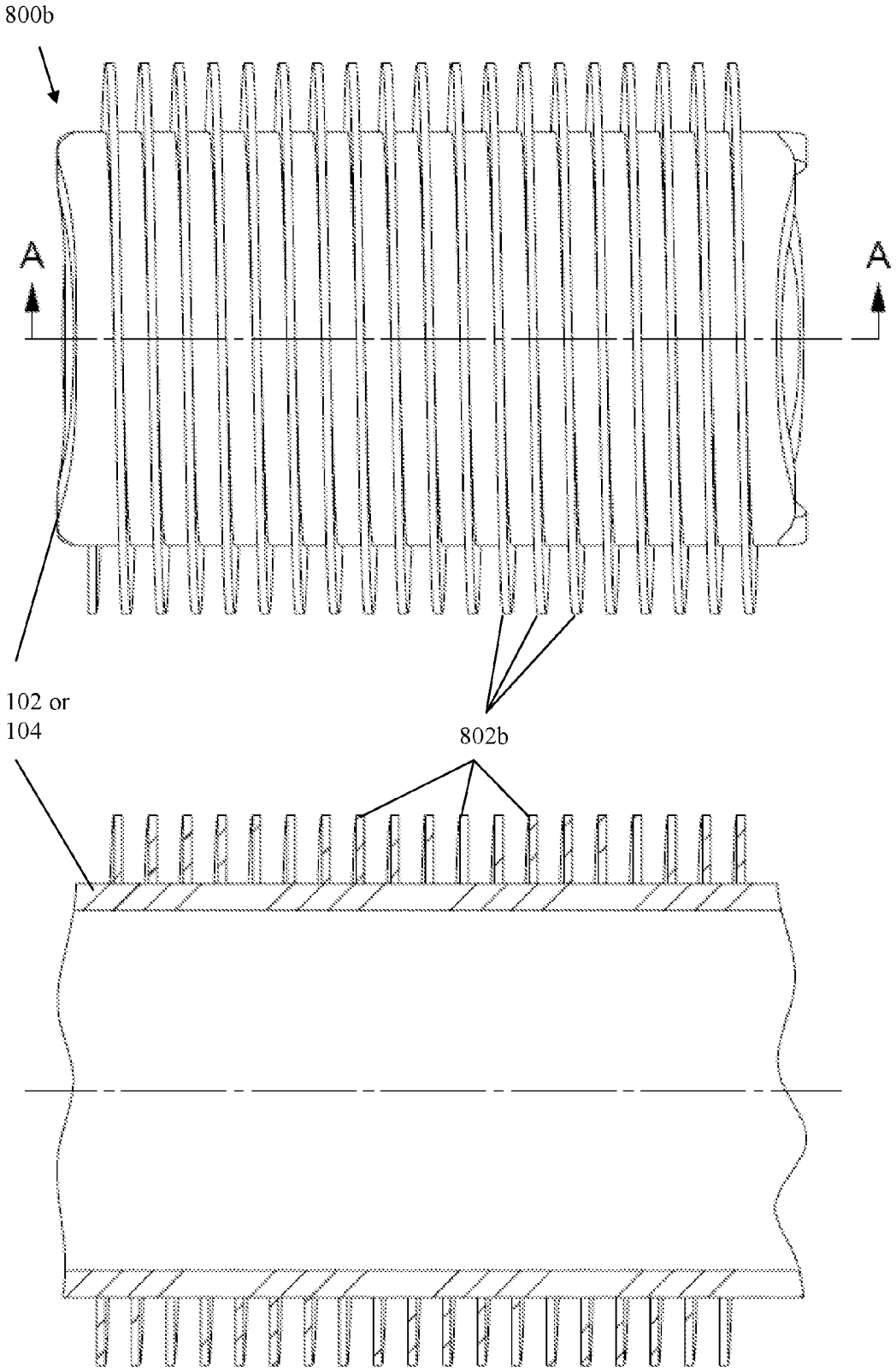

FIG. 8*b* shows a cross-sectional view of a segment of a tube with external fins.

Figure 6:
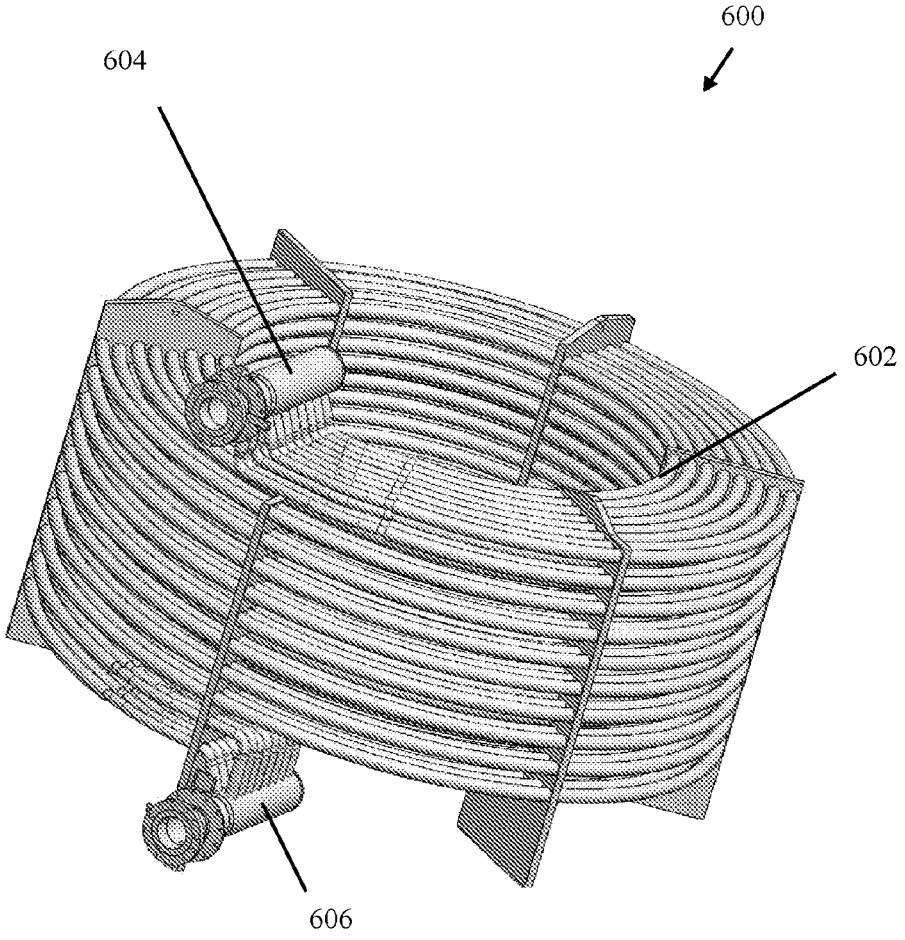
FIG. 6 shows a perspective view of a prior art heat exchange array.

A typical prior art heat exchange array 600 is shown in FIG. 6. The heat exchange array comprises a plurality of helically coiled tubes, the first of which is labelled 602.

Each of the coils runs from an input header 604 to an output header 606. All of the coils of the heat exchange array 600 have the same chirality, and so are attached to each of the input header and output header from the same direction. The stress forces within the coils will therefore combine such that they may cause a distortion in the shape of the heat exchange array 600.

Figure 7:
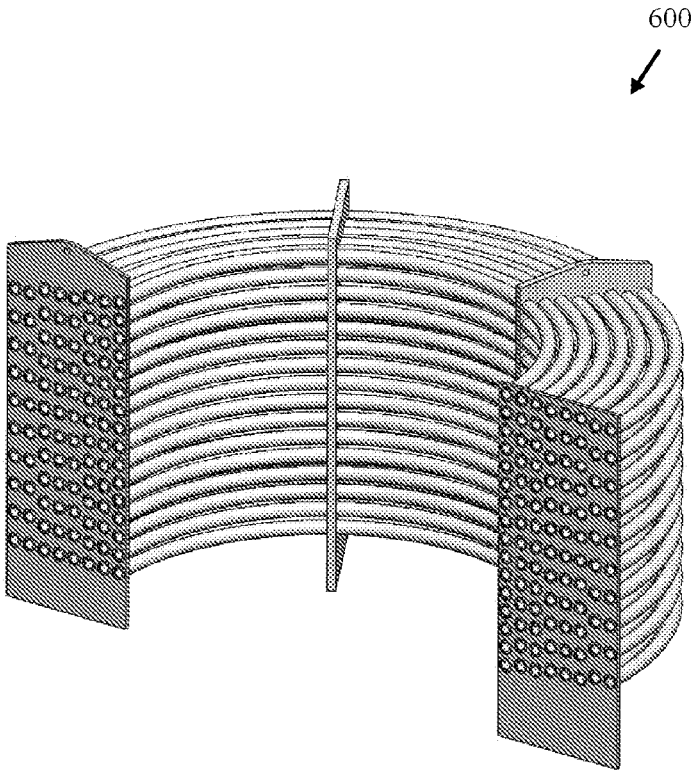
FIG. 7 shows a cross section view of the prior art heat exchange array shown in FIG. 6.

A cross sectional view of the prior art heat exchange array 600 is shown in FIG. 7. This view shows how helical coils of the same chirality are also difficult to pack efficiently, and cannot be easily distributed uniformly throughout the heat exchange array.

Figure 1:
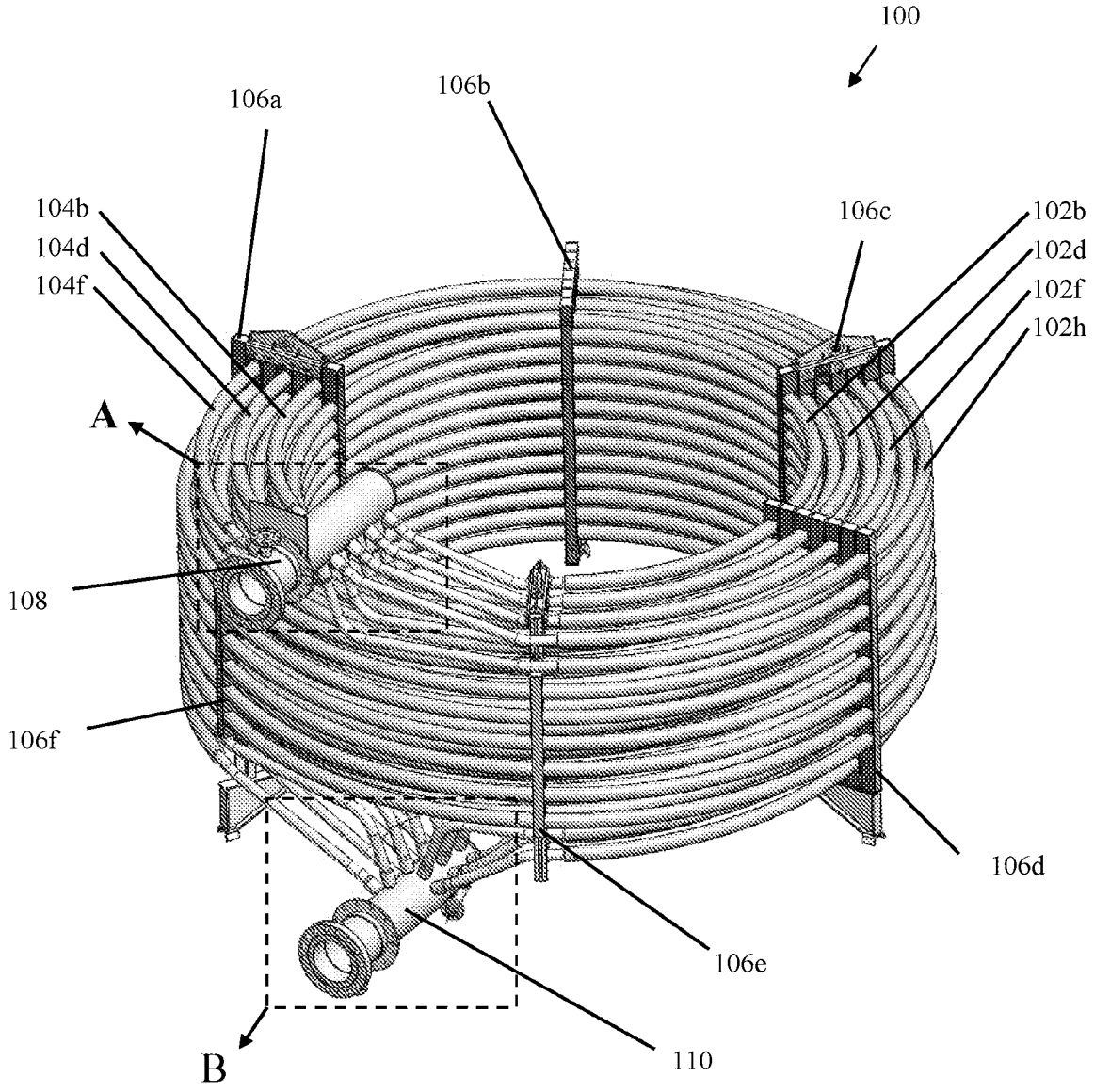
FIG. 1 shows a perspective view of a heat exchange array according to an embodiment of the present invention.
Figure 1A:
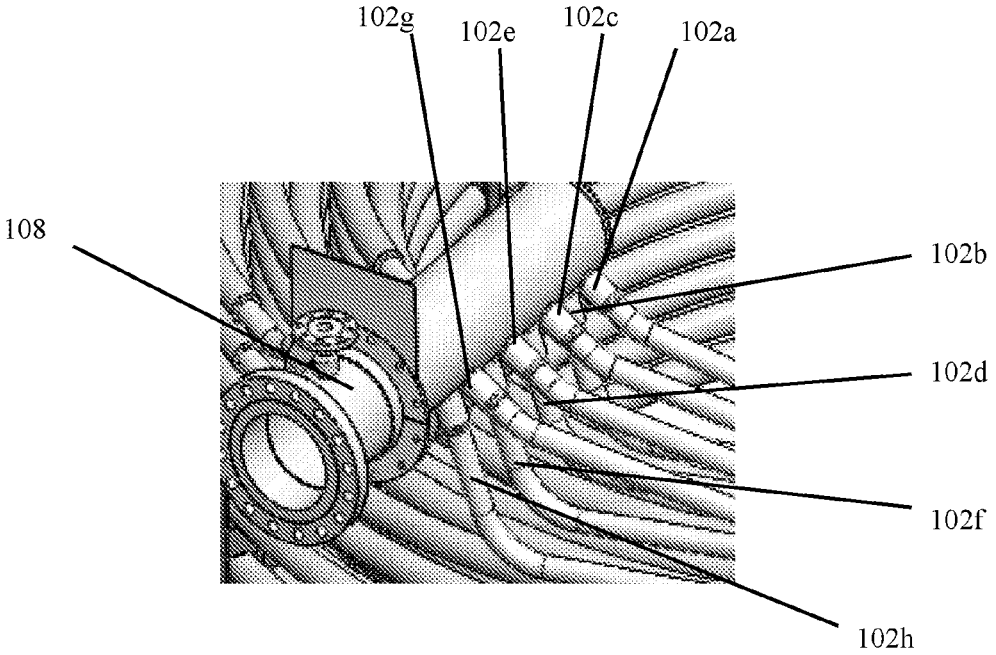
FIG. 1A shows expanded views of region A in FIG. 1.

FIG. 1 shows a heat exchange array 100 according to an embodiment of the present invention. The heat exchange array 100 comprises first heat exchange tubes 102 and second heat exchange tubes 104. In the embodiment shown in FIGS. 1, IA, 1B and 2, there are eight first heat exchange tubes 102*a*, 102*b*, 102*c*, 102*d*, 102*e*, 102*d*, 102*e*, 102*f* and six second heat exchange tubes 104*a*, 104*b*, 104*c*, 104*d*, 104*e*, 104*f*. Each of the heat exchange tubes is arranged to carry a heat exchange medium. The heat exchange medium may be water, or any other suitable fluid such as steam, oil, gas. The first heat exchange tubes 102 each comprise a left-handed helically coiled tube. The second heat exchange tubes 104 each comprise a right-handed helically coiled tube. A left-handed helix is defined as a helix where when viewed along the helix's axis, a clockwise screwing motion moves the helix towards the observer. A right-handed helix is defined as a helix where when viewed along the helix's axis, a clockwise screwing motion moves the helix away the observer.

The first 102 and second 104 heat exchange tubes are manufactured by winding a straight length of tubing into a helical coil. As the tubing is wound an elastic stress is generated within each tube that acts to return the tube to its original shape. The elastic stress generated within the first heat exchange tubes 102 will act in an opposite direction to that found in the second heat exchange coils 104 due to the tubes being wound into left-handed and right-handed helixes. The first 102 and second 104 heat exchange tubes are interconnected such that the elastic stress in the first heat exchange tubes 102 opposes the elastic stress in the second heat exchange tubes 104. The elastic stresses are therefore balanced and at least partly cancel out, thus reducing the overall stress within the heat exchange array 100.

The first heat exchange coils 102 and the second heat exchange coils 104 are arranged coaxially such that the heat exchange array 100 is made up of layers of concentric helical coils. Each layer of the heat exchange array 100 is made up of first heat exchange tubes 102 (having a left-handed helix) or second heat exchange tubes 104 (each having a right-handed helix). Each layer of heat exchange tubes surrounds the layer before—i.e. the radius of curvature of the helical coils of each layer increases further from the central axis. The composition of each layer alternates between being made up only of first heat exchange tubes 102 and only of second heat exchange tubes 104.

In the embodiment of FIGS. 1, IA, 1B and 2, the inner most layer comprises a pair of left-handed helical coils 102*a*,

102*b*. The next layer comprises a pair of right-handed helical coils 104*a*, 104*b*. The third layer comprises a pair of left-handed coils 102*c*, 102*d* and so on until the seventh layer, which comprises a pair of left-handed coils 102*g*, 102*h*. Hence there are four layers of first heat exchange tubes 102 and three layers of second heat exchange tubes 104. In other embodiments, there may be an equal number of layers of first heat exchange tubes 102 and second heat exchange tubes 104.

In other embodiments, each layer may comprise only one first 102 or second 104 heat exchange tube. In other embodiments, each layer may comprise any other suitable number of first 102 or second 104 heat exchange tubes depending on the size requirement of the heat exchange array. For example, each layer may comprise 3, 4, 5, 6 or more first or second heat exchange tubes.

The first 102 and second heat 104 exchange tubes are interconnected via support members 106, which in this embodiment are rigid, arranged to hold the helically coiled tubes 102, 104 in a fixed shape. In the embodiment shown in FIGS. 1, IA, 1B and 2 there are six support members 106*a*, 106*b*, 106*c*, 106*d*, 106*e*, 106*f*. In other embodiments there may be any other suitable number of support members.

The support members 106 each comprise a support bracket defining apertures arranged to receive each turn of the helically coiled tubes 102,104. The support members 106 are arranged to keep the heat exchange tubes 102, 104 in their coiled up shape.

In embodiments wherein the heat exchange tubes have fins, the support members 106 have a width sufficient to support a plurality of fins.

The heat exchange tubes are mechanically locked to the support members to secure them in position perhaps via a tang dependent from the support members 106. In some embodiments, the heat exchange tubes may have a tight friction fit with the apertures of the support member to secure them in place. As the tubes are fixed to the support members they may be more effectively interconnected such that the elastic stress forces can be counterbalanced. The support members may comprise two parts, each having a series of indentations arranged to receive the turns of the coils as they are wound. When the two parts are attached together the indentations are closed off to form apertures to fix the coils in place. Thus, each indentation may comprise a complementarily shaped recess arranged to receive a portion of a heat exchange tube.

The heat exchange array 100 further comprises an input header 108 and an output header 110. The headers 108, 110 are arranged to provide an input or output for a heat exchange medium into the tubes. The input header 108 is connected to a first end of each of the first 102 and second 104 heat exchange tubes. The output header 110 is connected to a second end of each of the first 102 and second 104 heat exchange tubes. The heat exchange medium can therefore flow into one end of the tubes via the input header, through the tubes such that heat exchange can occur, and then exit the tubes via the output header.

Figure 1B:
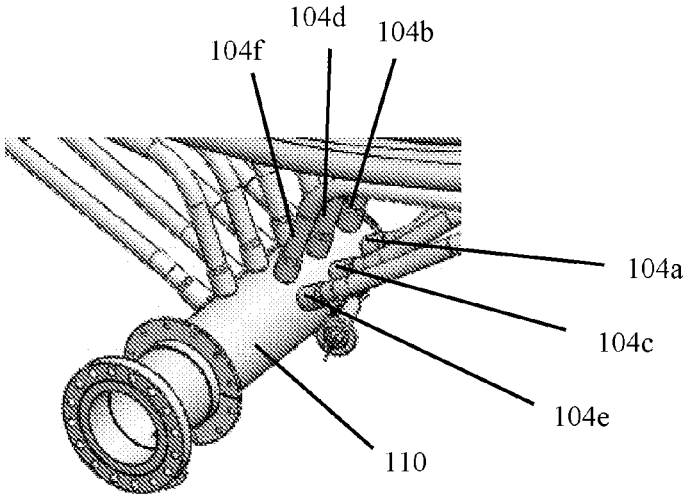
FIG. 1B shows an expanded view of region B in Figure.

As can be seen more clearly in FIG. 1*b*, each of the first heat exchange tubes 102 are connected to the output header 110 from an opposite direction (ie from either side of a vertical, as viewed in the figure, axis through the header) to each of the second heat exchange tubes 104. Similarly, each of the second heat exchange tubes 104 are connected to the input header 108 from an opposite direction (ie from either side of a vertical, as viewed in the figure, axis through the header) to each of the first heat exchange tubes 102. This improves access to the heat exchange tubes and allows them to be more easily welded, or otherwise attached, onto the input 108 and output 110 headers. Attaching the heat exchange tubes from opposite directions may also allow the elastic stresses within the first heat exchange tubes 102 acting on the headers 108, 110 to oppose the elastic stresses within the second heat exchange tubes 104.

Each of the first heat exchange tubes 102 has substantially the same length as each of the second heat exchange tubes 104. This means that the heat exchange medium travels the same distance in each of the heat exchange tubes, and therefore spends an equal amount of time in each of the heat exchange tubes if the heat exchange medium travels at the same speed. As a result the energy imparted to the heat exchange medium is substantially the same for each of the heat exchange tubes.

In order to allow the heat exchange tubes 102, 104 to have substantially the same length, the first heat exchange tube 102 comprise a left-handed helically coiled tube having a pitch that is different to that of the second heat exchange tube 104. The pitch of the helical coils increases in each consecutive layer moving outward from the central axis. The increasing helical radius of curvature in coils further from the central axis is therefore counter balanced by a change in pitch reducing the number of turns required in the coil.

Figure 2:
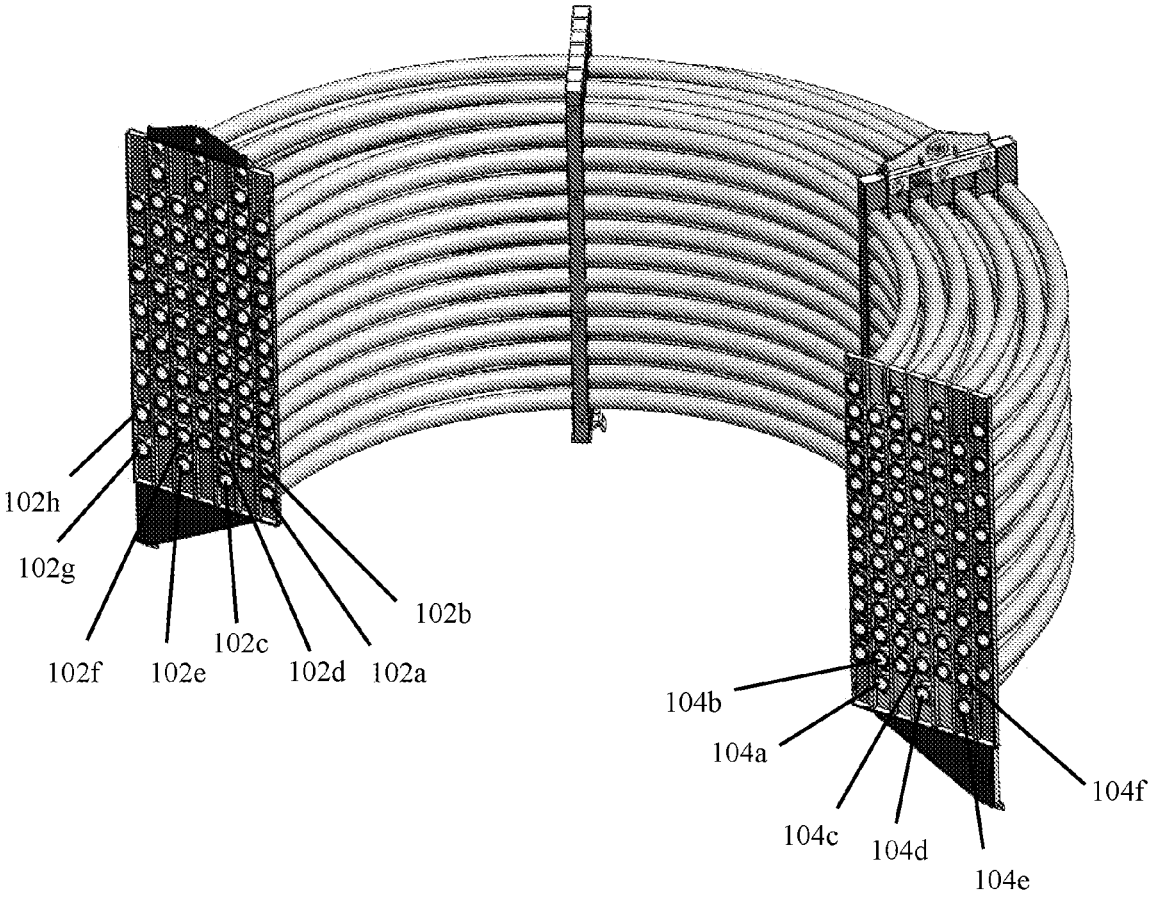
FIG. 2 shows a cross-section view through the heat exchange array shown in FIG. 1.

In some embodiments (not shown in FIGS. 1 and 2) either one, or both, of the first 102 and second 104 heat exchange tubes comprise external fins or other similar protrusions. Typically both heat exchange tubs comprise external fins. These increase the surface area of heat exchange tubes in order to improve the heat exchange efficiency. In some embodiments the fins or protrusions may also engage with the support member (i.e. are disposed on either side of the support member at the position where it is connect to the heat exchange tube) to help keep the tube fixed relative to the support member.

FIGS. 8*a* and 8*b* show schematics of segments 800*a*, 800*b* of tubes 102 and/or 104 in an embodiment wherein one or both of the tubes comprise external fins 802*a*, 802*b*. In the embodiment shown in FIGS. 8*a* and 8*b* the external fins 802*a*, 802*b* are spiral fins. In the embodiment shown, the turns of the external fins 802*a*, 802*b* are equi-spaced along the length of the tube. The individual turns of the spiral fin are referred to as external fins below for simplicity. The skilled person will understand that equi-spacing of the external fins is not a necessary feature, but may be preferable for even heat distribution in some embodiments.

In the embodiment shown in FIGS. 8*a* and 8*b*, the external fins 802*a*, 802*b* are substantially parallel to each other and substantially perpendicular to the tube surface.

The skilled person will understand that, as the tubes 102, 104 are coiled, the tube surfaces bend. The angle between the tube surface and the external fins 802*a*, 802*b* may change as the tubes are coiled such that adjacent external fins may no longer be parallel to each other and may even touch within the inner circumference of the coiled tube 102, 104. The skilled person will understand that the extent of the deviation of positioning and angle from that shown in FIGS. 8*a* and 8*b* is dependent on the radius of curvature of the tubes 102, 104 once coiled, the diameter of the tubes 102,104 and the depth of the external fin 802*a*, 802*b*.

In some embodiments, the support members 106 are sufficiently wide (ie have a sufficient width) to support more than one external fin 802*a*, 802*b* on each turn of the helically coiled tubes 102,104 received.

In the embodiment shown in FIGS. 1, IA, 1B and 2 the first 102 and second 104 heat exchange tubes are circular in cross section, and have a diameter of between approximately 21.3 mm and 168.3 mm. The radius of curvature of the left-handed helically coiled tube and right-handed helically coiled tube is between roughly 1 m and 4 m.

In the embodiment shown in FIGS. 1, IA, 1B and 2 the external fins 802*a*, 802*b* of the first 102 and second 104 heat exchange tubes have heights of between approximately 10 mm and 240 mm, and more preferably between 20 mm and 50 mm.

The heat exchange array 100 may be assembled into a heat exchange unit by enclosing the heat exchange tubes in a duct through which exhaust gas is passed.

Figure 3:
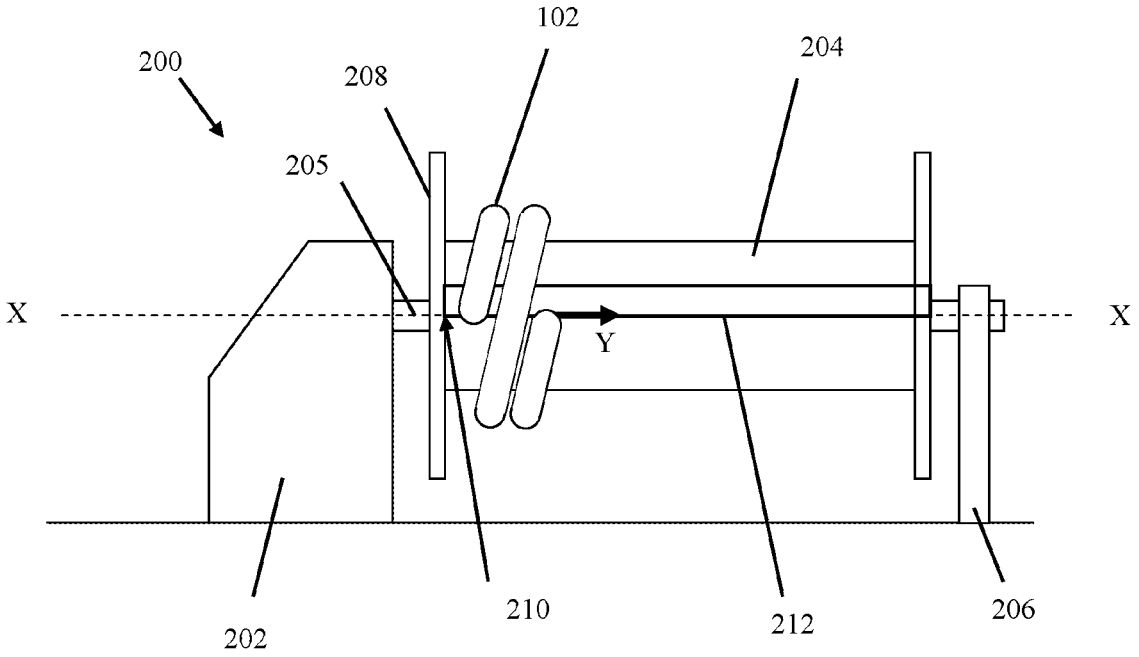
FIG. 3 shows cross-section view through a rotatable mandrel used to manufacture the heat exchange array shown in FIG. 2, the heat exchange array being at a first stage of production.
Figure 4:
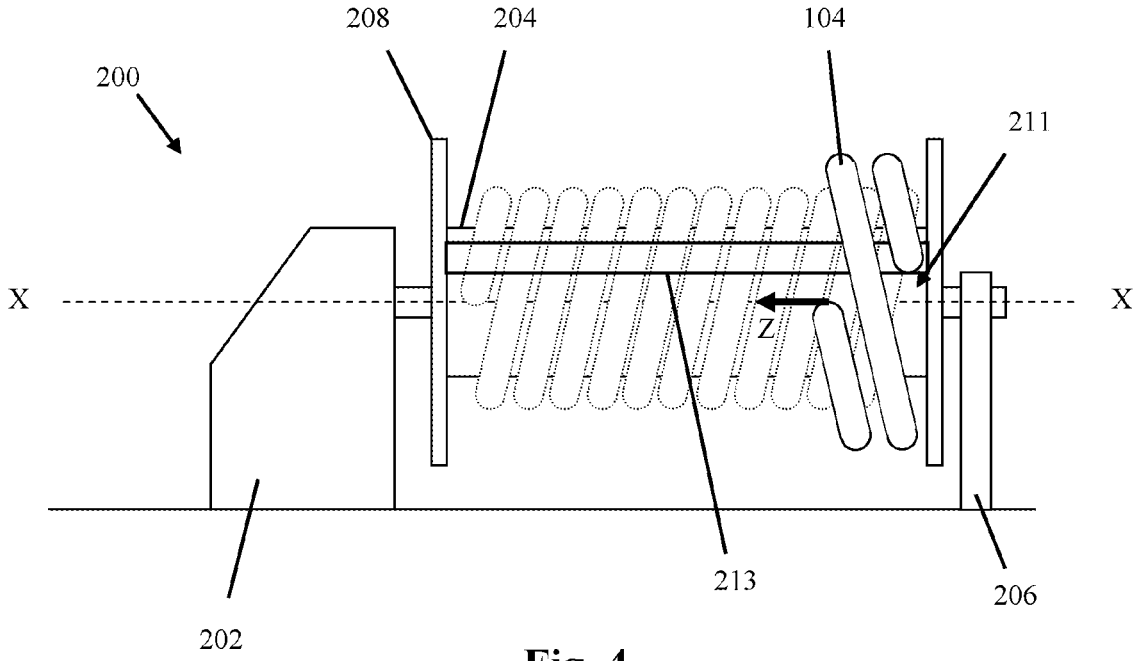
FIG. 4 shows cross-section view through a rotatable mandrel used to manufacture the heat exchange array shown in FIG. 2, the heat exchange array being at a second stage of production.

FIGS. 3 and 4 show a method of producing the heat exchange array 100 using a rotating mandrel 200. The mandrel 200 comprises a drive means 202 which is arranged to rotate a roller portion 204. The rotating portion is substantially cylindrical in shape and is rotated by an axle 205 about central axis XX shown in FIGS. 3 and 4. Thus, it will be appreciate that the line XX lies substantially along an axial direction of the array that is formed by the method. The axle 205 is driven at one end by the drive means 202 and supported at the other by a supporting means 206. Coil support frame 208 is provided at the ends of the rolling portion 204 to keep the heat exchange tubes in place.

The method of producing the heat exchange coil comprises the following steps:

(a) A first support member 212 is attached to the roller portion 204, aligned with its length parallel to the axis of rotation XX. In other embodiments there may be more than one first support member, arranged around the circumference of the roller portion 204. In the embodiment being described, there are 6 support members but in other embodiments there may be typically 3, 4, 5, 7, 8, 10, 12, support members.

The first support member 212 is arranged to receive the first heat exchange tube 102 as it is wound onto the roller portion 204. The first support member 212 comprises a series of grooves or indentations arranged to receive each turn of the first heat exchange tube 102.

(b) One end of the first heat exchange tube 102 is held to the first support member 212 towards a first end 210 of the roller portion 204.

(c) As the roller portion 204 is rotated, the first heat exchange tube 102 is fed towards the roller portion 204 whilst simultaneously moving the feed point (the point at which it is held to the support member) along the length of the roller 204 in a first direction (shown by the arrow marked Y in FIG. 3) parallel to the central axis XX of rotation. This winds the first heat exchange tube into a helical coil around the roller portion 204, with each turn of the coil kept in place by being received by the indentations of the first support member 212.

(d) Once the first heat exchange tube 102 has been wound into a helical coil, a second support member 213 is attached the first support member 212, arranged to receive a second heat exchange tube 104. The first 212 and second 213 support members are fixed together to close the indentations of the first support member 212 and secure the first heat exchange tube 102 in place. The second support member 213 is arranged to receive the second heat exchange tube 104 as it is wound onto the roller portion 204. The second support 213 member comprises a series of grooves or indentations arranged to receive each turn of the second heat exchange tube 104.

(e) One end of the second heat exchange tube 104 is held to the second support member 213 towards a second end 211 of the roller portion 204. The first end 210 is opposite to the first end 211, i.e. at distal ends of the roller portion 204.

(f) Whilst rotating the roller in the same direction, the second heat exchange tube 104 is fed towards the roller portion 204 and the feed point simultaneously moved along the length of the roller in a second direction parallel to the axis of rotation (shown by the arrow marked Z in FIG. 4). This winds the second heat exchange tube 104 into a helical coil around the roller portion 204, with each turn of the coil kept in place by the indentations of the second support member 213.

Conveniently, shims are periodically placed upon the inner heat exchange tube is a outer heat exchange tube is wound therearound. Typically, the shim is placed at intermediate positions between the support members and helps to ensure that the tubes bend between the support members, and take a curved shape, as the mandrel 200 is rotated. The shims may or may not be removed from the after the heat exchange array has been fabricated.

As the first direction (arrow Y) is opposite to the second direction (arrow Z) first heat exchange tube 102 is wound into a helical coil within an opposite chirality to that of the second heat exchange tube 104 (i.e. one forms a left-handed helix and the other a right-handed helix).

Figure 5:
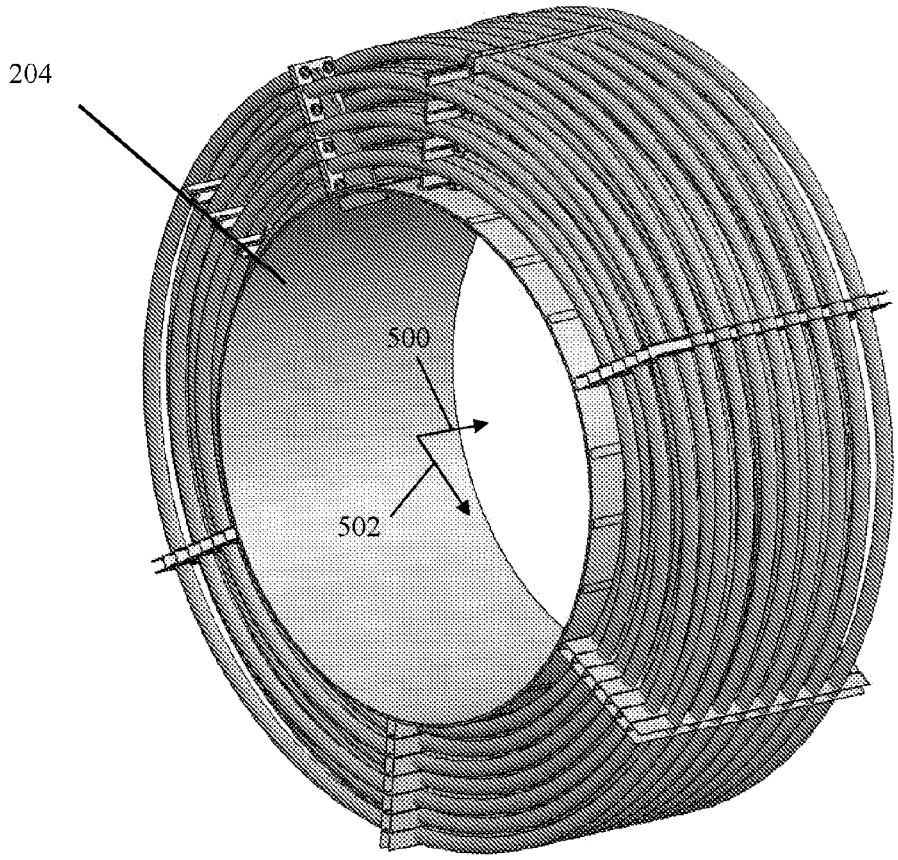
FIG. 5 shows a perspective view of a rotatable mandrel used to manufacture the heat exchange array shown in FIG. 2, the heat exchange array being at a third stage of production.

Steps (a) to (f) above may be repeated to build up a heat exchange array comprising a plurality of the first 102 and/or the second 104 heat exchange coils in a plurality of concentric layers as shown in FIG. 5. It can be seen with reference to FIG. 5 that each of the support member has a length along the circumferential length of a coil such that the or each support member supports a plurality of fins.

FIG. 5 also has labelled for ease of reference two axes: the axial direction 500 of the coils and the array; and the radial direction 502 of the coils and the array. When referring to the support members and the shims, it is convenient to think of the height thereof as being in the radial direction 502 and the width being substantially in the circumferential direction of a coil supported by the shim/support member.

In step (b) a plurality of first heat exchange tubes 102 may be held to the first support member 212 so that each concentric layer comprises a plurality of first heat exchange coils 102. Similarly, in step (e), a plurality of second heat exchange tubes 104 may be held to the second support member 213 so that each concentric layer comprises a plurality of first heat exchange coils 104.

During steps (c) and (f), a pulling force away from the roller portion 204 is applied to the heat exchange tubes 102, 104. The pulling force helps to ensure that the heat exchange tubes 102, 104 are coiled tightly. If the heat exchange tubes 102, 104 are coiled too loosely, the coil may spring away from the support members 212 and not retain the desired shape.

In order to control the pitch of each of the helical coils, the spacing between the indentations of the support members may be adjusted. By increasing the spacing of the indentations along the length of the rotating portion 204, the pitch of the helical coil wound onto it will be increased.

Various modifications will be apparent to the skilled person. For example, the first direction Y and the second direction Z could be the same i.e. the first and second heat exchange tubes are wound onto the roller portion 204 from the same end. In this case the direction of rotation of the roller portion 204 can be reversed between each layer to produce helical coils with opposite chirality.

The invention claimed is:

1. A power plant heat exchange array arranged to be used in a heat exchange unit and to recover energy from an exhaust gas from a gas turbine in the power plant, the heat exchange array comprising:

a first heat exchange tube and a second heat exchange tube, each arranged to carry a heat exchange medium and further each comprising a series of external fins, wherein the first heat exchange tube comprises a left-handed helically coiled tube having a first elastic stress from plastic and elastic deformation in manufacture, and the second heat exchange coil comprises a right-handed helically coiled tube having a second elastic stress from plastic and elastic deformation in manufacture, and wherein the first and second heat exchange tubes are interconnected such that the first elastic stress opposes the second elastic stress; and a header connected to an end region of the first heat exchange tube and an end region of the second heat exchange tube, the header arranged to provide an input or output for a heat exchange medium into the tubes, wherein the header extends outward from the coil central axis, wherein the first and second heat exchange tubes are connected to the header from opposing directions, wherein the first and second heat exchange tubes are interconnected via a support member arranged to hold both the left-handed helically coiled tube and the right-handed helically coiled tube in a fixed shape, the support member comprising at least one support bracket, each support bracket defining holes arranged to receive turns of both the left-handed helically coiled tube and the right handed helically coiled tube, and wherein each of the at least one support bracket has a length along the circumferential direction of the coils of the array such that the load carried by each of the at least one support bracket is transferred from a corresponding circumferential length of the tube to the support bracket through a plurality of fins.

2. The heat exchange array according claim 1 wherein the first heat exchange tube has substantially a same length as the second heat exchange tube.

3. The heat exchange array according to claim 1 wherein the left-handed helically coiled tube of the first heat exchange tube comprises a first pitch and the right-handed helically coiled tube of the second heat exchange tube comprises a second pitch, wherein the first pitch is not equal to the second pitch.

4. The heat exchange array according to claim 1 wherein the first heat exchange tube and the second heat exchange tube are arranged co-axially.

5. The heat exchange array according to claim 1 wherein the first heat exchange tube surrounds the second heat exchange tube, or vice versa.

6. A heat exchange unit comprising the heat exchange array of claim 1.

7. The heat exchange array according to claim 1, wherein the support bracket has a length selected from one of: from 20 mm to 100 mm; from 40 mm to 80 mm; and 60 mm.

8. The heat exchange array according to claim 1, wherein each support bracket supports one of: from 3 to 20 fins, from 5 to 15 fins; and 12 fins.

9. A method of manufacturing a heat exchange array comprising a plurality of heat exchange tubes, each heat exchange tube comprising a plurality of external fins, using a rotatable mandrel, the method comprising the steps of:

(a) providing at least one first support member on a roller portion of the mandrel to receive the first heat exchange tube;

(b) holding one end of a first heat exchange tube to the first support member;

(c) rotating the roller, whilst feeding the first heat exchange tube along a length of the roller in a first direction to form the first heat exchange tube into a first helical coil having a first chirality;

(d) attaching a second support member, arranged to receive a second heat exchange tube, to the first support member;

(e) holding one end of the second heat exchange tube to the second support member;

(f) rotating the roller in the same direction, whilst feeding the second heat exchange tube along a length of the roller in a second direction to form the second heat exchange tube into a second helical coil having a second chirality, wherein the first direction is opposite to the second direction such that the first chirality is of opposite chirality to the second chirality wherein the first heat exchange tube has the first chirality and a first elastic stress from plastic and elastic deformation in manufacture, and the second heat exchange coil has the second chirality a second elastic stress, from plastic and elastic deformation in manufacture; and (g) providing a header connected to an end region of the first heat exchange tube and an end region of the second heat exchange tube, the header arranged to provide an input or output for a heat exchange medium into the tubes, wherein the header extends outward from the coil central axis, wherein the first and second heat exchange tubes are connected to the header from opposing directions, and wherein the first and second heat exchange tubes are interconnected such that the first elastic stress opposes the second elastic stress and wherein the first and second heat exchange tubes are interconnected via the first and second support members, wherein each of the first and second support members are arranged to hold both the first helical coil and the second helical coil in a fixed shape, each support member comprising at least one support bracket defining holes arranged to receive turns of both the first helical coil and the second helical coil wherein each support bracket has a length along the circumferential direction of the coils of the array such that the load carried by each support bracket is transferred from a corresponding circumferential length of the tube to the support bracket through a plurality of fins.

10. The method of manufacturing a heat exchange array according to claim 9, wherein the method further comprises repeating steps (a) to (g) to provide a heat exchange array comprising a plurality of the first and/or the second heat exchange coils in a plurality of concentric layers.

11. The heat exchange array according to claim 10 wherein the radius of curvature of the left-handed helically coiled tube and right-handed helically coiled tube is between 1 m and 4 m.

12. The heat exchange array according to claim 11 wherein each of the concentric layers comprises a plurality of left-handed helically coiled tubes each having the same radius of curvature, or a plurality of right-handed helically coiled tube tubes each having the same radius of curvature.

13. The heat exchange array according to claim 11 or claim 6 wherein the concentric layers alternate between comprising the first heat exchange tubes and comprising the second heat exchange tubes.

14. The heat exchange array according to claim 11 comprising an equal number of the first and the second heat exchange tubes.

15. The heat exchange array according to claim 10 wherein the first and second heat exchange tubes are circular in cross section and have a diameter of approximately between 21 mm and 168 mm.

16. The heat exchange array according to claim 15, further comprising a plurality of first and/or second heat exchange tubes arranged into a plurality of concentric layers.

17. The method of manufacturing a heat exchange array according to claim 9, wherein step (b) comprises holding a plurality of first heat exchange tubes to the first support member so that each concentric layer comprises a plurality of first heat exchange coils.

18. The method of manufacturing a heat exchange array according to claim 9, wherein step (e) comprises holding a plurality of second heat exchange tubes to the second support member so that each concentric layer comprises a plurality of second heat exchange coils.

19. The method of manufacturing a heat exchange array according to claim 9, in which shims are placed at intermediate positions between support members as the tubes are wound.

* * * * *